United States Patent [19]

Stewart

[11] 4,143,485

[45] Mar. 13, 1979

[54] GAME CALLS

[75] Inventor: Johnny E. Stewart, Waco, Tex.

[73] Assignee: Stewart Game Calls, Inc., Waco, Tex.

[21] Appl. No.: 741,718

[22] Filed: Nov. 15, 1976

[51] Int. Cl.[2] ..... A63H 5/00

[52] U.S. Cl. ..... 46/180

[58] Field of Search ..... 46/174, 178, 179, 180, 46/181

[56] References Cited

U.S. PATENT DOCUMENTS

| | | | |
|---|---|---|---|
| 726,277 | 4/1903 | Fuller | 46/180 |
| 2,396,359 | 3/1946 | Yager | 46/180 |
| 2,493,472 | 1/1950 | Yentzen | 46/180 |
| 2,928,209 | 3/1960 | Johnson | 46/180 |
| 3,066,444 | 12/1962 | Dieckmann | 46/180 |
| 3,991,513 | 11/1976 | Faulk | 46/180 |

*Primary Examiner*—Russell R. Kinsey
*Assistant Examiner*—Robert P. Swiatek
*Attorney, Agent, or Firm*—Diller, Ramik & Wight

[57] ABSTRACT

This disclosure relates to a novel game call which utilizes in a reed assembly, a reed holder, a pair of reeds and a voice channel, the reed assembly being telescopically received within a barrel and the barrel having a shoulder and a tapered surface constructed and arranged so as to uniform and control pitch from game call to game call and/or upon disassembly and reassembly of a game call; the game call being further provided with unique means for maintaining the pair of reeds sandwiched between the reed holder and the voice channel, and one of the reeds having a surface finish rendering it stiffer than an opposite surface thereof with the stiffer surface opposing the remaining reed to again assure desired and uniform pitch.

32 Claims, 4 Drawing Figures

GAME CALLS

Game calls of the type to which this invention is directed are relatively standard equipment for sportsman, hunters, etc., and in general, most are satisfactory for their intended purpose or purposes. However, several disadvantages of conventional game calls are the inability thereof from game call to game call to produce generally identical pitch, to produce the desired pitch upon disassembly and reassembly with or without substituted elements, and ease of assembly or reassembly to assure the exact positioning of the various components of the game call to maintain repetitive desired pitch.

In keeping with the foregoing, it is a primary object of this invention to provide a novel game call in which a reed assembly is defined by a pair of adjacent reeds sandwiched between a reed holder and a voice channel with means for accurately locating the latter components in assembled relationship. The reed holder including means in bearing engagement with the first of the reeds, a barrel telescopically receiving the reed assembly, and the barrel being provided with a tapered internal surface and an abutment shoulder cooperative with the reed holder and voice channel respectively to assure proper pressure at the point of bearing engagement between the reed holder, bearing engagement means and the first reed whereby uniform pitch or sound characteristics are achieved by each game call or from game call to game call or upon the disassembly and reassembly of any particular game call.

A further object of this invention is to provide a novel game call of the type heretofore described wherein the first and second reeds have free terminal end portions, one of the reeds has a surface which opposes the second reed which is stiffer than the opposite remaining surface of the first reed, and the latter differential in surface stiffnesses achieving desired and repetitive pitch.

Yet another object of this invention is to provide a novel game call of the type aforesaid wherein the locating means include projecting locating pins carried by either the reed holder or the voice channel and aperture means formed in the other of the reed holder, voice channel and reeds, and the aperture means telescopically receiving the pins.

Still another object of this invention is to provide a novel game call of the type herein set forth wherein the pins are arranged in pairs and each pin and aperture of a pair is longitudinally offset from the remaining pin and aperture of the same pair of assure proper assembly of the reed assembly.

Still another object of this invention is to provide a novel game call of the type aforesaid wherein the voice channel has a generally convex surface in opposing relationship to the second of the reeds, and second means being carried by the reed holder in bearing engagement with the first reed inboard of a terminal end of a first reed for urging the first and second reeds into general conformity with at least a portion of the convex surface of the voice channel.

Another object of this invention is to provide a novel game call of the type aforesaid including boss means carried by the first reed adjacent its terminal end projecting toward a terminal end of the second of the reeds to maintain the reeds at all times in minimum spaced relationship relative to each other to assure desired pitch.

A further object of this invention is to construct the reed possessing the different surface stiffnesses from polymeric plastic material, such as vinyl plastic, and the stiffer surface being formed of a planished surface.

With the above and other objects in view that will hereinafter appear, the nature of the invention will be more clearly understood by reference to the following detailed description, the appended claimed subject matter, and the several views illustrated in the accompanying drawings.

Figures 1, 2, 3, 4:
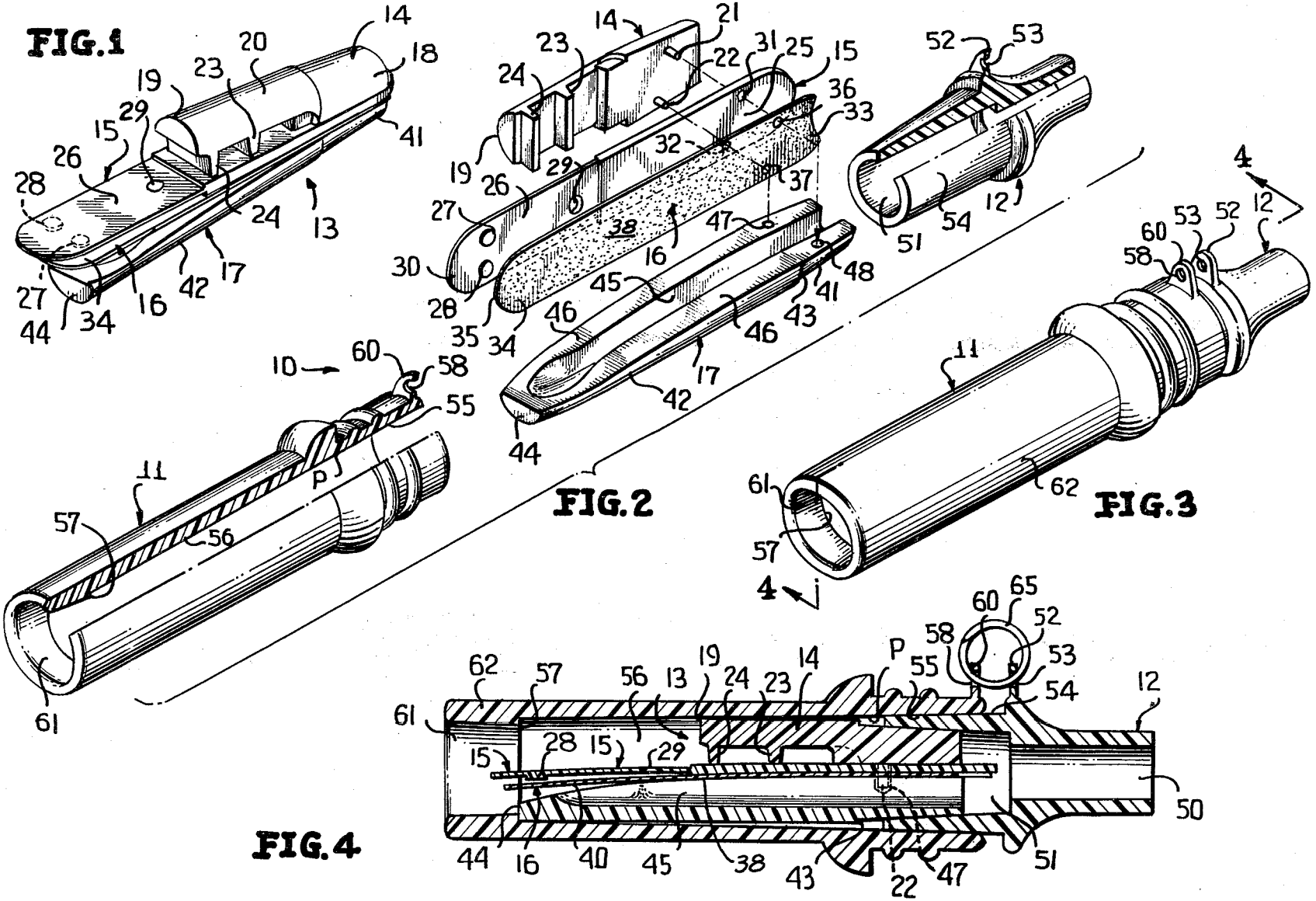
FIG. 1 is a perspective view of a reed assembly forming a portion of a game call of this invention, and illustrates upper and lower reeds sandwiched between a reed holder and a voice channel.
FIG. 2 is a disassembled view partially in cross-section of the overall game call, and illustrates a barrel which telescopically receives the reed assembly, an exploded view of a reed assembly, a voice holder, and locating means in the form of pins and apertures of the reed assembly for accurately locating the components of the reed assembly.
FIG. 3 is a perspective view of the game call, and illustrates the same in assembled condition.

FIG. 4 is an axial sectional view taken generally along line 4—4 of FIG. 3, and more clearly illustrates the assembled game call, and specifically, bearing engagement between a terminal end of the voice channel and a shoulder of the barrel adjacent a mouthpiece portion of the latter, engagement between an exterior surface of the reed holder and a tapered interior surface of the barrel, and engagement of a bottom surface of the voice channel and a tapered interior surface of the barrel.

A game call constructed in accordance with this invention is generally designated by the reference numeral 10 (FIGS. 2 through 4) and includes a barrel 11, a voice holder 12 and a reed or voice assembly 13, all of which are constructed from polymeric or copolymeric material.

The reed or voice assembly 13 includes a reed holder 14, an upper reed 15, a lower reed 16, and a voice channel 17 with the reeds 15, 16 being sandwiched between the reed holder 14 and the voice channel 17 in the manner clearly illustrated in FIGS. 1 and 4 of the drawings.

The reed holder 14 includes a surface 18 tapered at an angle of approximately two degrees and another surface 20 which is generally perfectly cylindrical and terminates at a front bearing edge 19. An underside (unnumbered) of the reed holder 14 includes a pair of projecting guide pins 21, 22 which cooperate in a manner to be described hereinafter to accurately locate the components of the reed holder 14 in assembled relationship. The pins 21, 22 are longitudinally offset from each other, also for a purpose which will be described hereinafter. A pair of transverse pressure bars 23, 24 project from the underside of the reed holder 14 in the area beneath the cylindrical surface 20. The pressure bars 23, 24 serve two distinct functions which will be described further hereinafter.

The upper reed 15 includes a terminal end portion 25 and an opposite thinner terminal end portion 26, the latter of which includes a pair of projecting bosses 27, 28 spaced from a free terminal end 30 which is preferably, though not ncessarily, rounded. The bosses are each of a diameter of approximately ⅛ inch and an axial height of approximately 0.005 inch. The distance between from the centers (unnumbered) of the bosses 27, 28 to the terminal end 30 is approximately 0.300 inch. Aperture means 29 in the form of a circular hole is formed in the thinner terminal end portion 26 of the upper reed 15 generally along a longitudinal center line of the reed 15. The aperture 29 has been found to impart desired and natural raspiness to the sound emitted from the game call when in use. The thickened terminal end portion 25 of the upper reed 15 includes apertures or holes 31, 32 which are identically longitudinally offset as are the guide pins 21, 22 to respectively receive the latter and maintain accurate alignment between the upper reed 15 and the reed holder 14 in a manner apparent from FIG. 2 and illustrated best in FIG. 4. The distance from the terminal end 30 to the center of the aperture or opening 31 which is spaced further from the terminal end 30 than the aperture 32 is 2.715 inch. Upon the assembly of the reed holder 14 and the upper reed 15 by means of the pins 21, 22 being received in the respective apertures 31, 32, the transverse pressure bars 23, 24 of the reed holder 14 bear against an upper surface (unnumbered) of the thickened terminal end portion 25 of the upper reed 15, as is best illustrated in FIGS. 1 and 4 of the drawings.

The lower reed 16 likewise includes a terminal end portion 33, an opposite terminal end portion 34 which terminates in a terminal end 35 which though rounded or arcuate need not necessarily be of the latter configuration. The terminal end portion 33 of the lower reed 16 also includes aperture means or openings 36, 37 which are aligned with the respective apertures 31, 32 of the upper reed 15 and telescopically receive the respective guide pins 21, 22 of the reed holder 14, as is most apparent from FIG. 2 and is partially illustrated in FIG. 4. As noted heretofore, the reed 16 is constructed from polymeric or copolymeric plastic material, such as vinyl, and a lower surface 38 thereof is shown stippled to indicate an unpolished or unplanished surface of the reed 16 whereas an opposite surface 40 (FIG. 4) which opposes the upper reed 15 is planished or polished. Experiments have shown that with the planished or polished side 40 of the lower reed 16 opposing the terminal end portion 26 of the upper reed 15, the vibrating characteristics are enhanced and repetitive desired pitch is achieved; the terminal end portion 34 of the lower reed 16 is thinner than the terminal end portion 26 of the reed 15. Thus, when in use, the sound characteristic or pitch of the call is achieved by vibration of the terminal end portion 34 of the reed 16 while the terminal end portion 36 remains virtually stationary. The maximum distance from the terminal end 35 to the aperture 36 most remote therefrom is approximately 2.690 inch resulting in the terminal end 35 of the lower reed 16 being inboard of the terminal end 30 of the upper reed 15, as is best illustrated in FIG. 4.

The voice channel 17 includes a first terminal end portion 41 and a second terminal end portion 42 separated by a shoulder 43. The exterior surface of the terminal end portion 41 to the right of the shoulder 43, as viewed in FIGS. 1, 2 and 4, is slightly frusto-conical (2% taper) in configuration. The exterior surface of the terminal end portion 42 similarly tapers from the shoulder 43 toward a terminal abutment end face 44. A channel or slot 45 opens through the end face (unnumbered) remote from the end face 44 and terminates short of the end face 44 as is best illustrated in FIGS. 2 and 4. An upper surface 46 of the voice channel 17 is convexly caved upwardly in opposing relationship to the surface 38 of the lower reed 16. The terminal end portion 41 further includes aperture means or bores 47, 48 which receive the respective pins 22, 21. Thus, the apertures or bores 47, 48 in conjunction with the apertures 31, 32, 36 and 37 and the pins 21, 22 collectively define means for accurately locating the reed holder 14, the upper reed 15, the lowr reed 16, and the voice channel 17 in assembled relationship (FIG. 1). Furthermore, though the pins 21, 22 are shown carried by the reed holder 14, the same may be carried by the voice channel 17 in lieu of the bores 47, 48 and like bores could instead be formed in the reed holder 14 in lieu of the guide pins 21, 22.

The voice holder 12 (FIGS. 2, 3 and 4) includes a cylindrical bore 50 and a frusto-conical bore 51 with the taper of the bore 51 corresponding to the taper of the surfaces 18, 41 of the respective reed holder 14 and the voice channel 17. A lanyard hole 53 is provided in an upwardly extending projection 52 of the voice holder 12. An exterior surface 54 of the voice holder 12 is also tapered and the degree of taper corresponds generally to an entrance end tapered surface 55 of an internal bore 56 of the barrel 11. The tapered surface 55 extends from the righthandmost end (unnumbered) of the barrel 11 as viewed in FIG. 4 toward a point P and from the point P toward an abutment shoulder 57, the taper of the surface 56 is approximately 1 degree. As in the case of the voice holder 12, the barrel 11 includes a lanyard hole 58 formed in a projection 60. The lefthand end portion (unnumbered) of the barrel 11, as viewed in FIG. 4, terminates in a slightly tapered bore 61 at the mouthpiece end 62 of the barrel 11.

In order to assemble the game call 10, as shown fully assembled in FIGS. 3 and 4, the components 14 through 17 of the reed assembly 13 are assembled in the manner heretofore described to the assembled condition of FIG. 1. Thereafter, the reed assembly 13 is inserted into the tapered bore 51 of the voice holder 12. This is done simply by aligning the center of the surfaces 20, 18 with the lanyard hole 52 and pushing the two elements 12, 13 together to achieve a snug though not tight friction fit. Thereafter, the lanyard hole 58 of the barrel 11 is aligned with the lanyard hole 53 of the reed holder 14 and the barrel 11 is telescoped onto the reed holder 14 toward the fully seated position shown in FIG. 4. During this assembly, the front bearing edge 19 and the surface 20 of the reed holder 14 progressively move along the surface 55 of the barrel 11, then pass the point P after which they move along the one degree tapered surface. Due to this one degree tapered surface, the transverse pressure bars 23, 24 are progressively moved into bearing engagement with the thickened terminal end portion 25 of the upper reed 15, the terminal abutment end face 44 of the voice channel 17 moves toward the shoulder 57 of the barrel 11 and the surface 51 of the voice holder 12 moves into tighter engagement against the surfaces 18, 41 of the respective reed holder 14 and the voice channel 17. Due to the one degree portion of the surface 56 and the abutment between the end face 44 of the voice channel 17 and the shoulder 57 of the barrel 11, the transverse pressure bar 24 creates a desired pressure at the point of bearing engagement between the transverse pressure bar 24 and the upper reed 15 to in effect clamp both of the reeds between the transverse pressure bar 24 and the upper surface 46 of the voice channel 17. Due to so obtaining this desired pressure, the call 10 is automatically tuned, or the desired pitch characteristic is obtained irrespective of subsequent disassembly or reassembly or from game call to game call. Irrespective of subsequent disassemblies and reassemblies, the voice channel 17 can only move to the left relative to the barrel 11 as viewed in FIG. 4 until abutment occurs between the end face 44 and the shoulder 57. The voice holder 12 can only move to the left until friction of tapered surfaces 18 and 41 entering bore 51 prevents further movement because of the interlocking between the guide pins 21, 22, the apertures 31, 32, 36, 37 and the bores 47, 48, the entire reed assembly is held in its original assembled position. Therefore, since the reed assembly 13 is inserted in unison within the barrel 11, the combination of the one degree taper and the abutment provided between the shoulder 57 and the terminal abutment end face 44 assures that the same bearing pressure is achieved by the transverse pressure bar 24 against the reeds 15, 16 thereby achieving repetitive desired tuning of the game call 10.

This desired tuning is also augmented by the fact that a minimum distance is at all times maintained between the terminal end portion 26, 34 of the respective reeds 15, 16 due to the bosses 27, 28, the fact that the surface 40 of the reed 16 opposing the terminal end portion 26 of the reed 15 is stiffer than the under surface 38 of the reed 16, and the fact that the transverse pressure bar 24 also assures intimate sandwiched clamping of the reeds 15, 16 between the upper surface 46 of the voice channel 17 and the under surface (unnumbered) of the reed holder 14.

In further keeping with this invention, the various components of the game call 10 are retained in assembled relationship not only by the frictional engagement therebetween but also by means of a split-ring 65 (FIG. 4) or equivalent tethering means which passes through the lanyard holes 53, 58. Thus, as one blows through the mouthpiece end 62 any tendency of the force of the air to otherwise disassemble the components is precluded by the tethering means 65 which assures that the voice holder 12 will not be blown outwardly of the barrel 11 and, for example, lost in water which might otherwise occur when the call is used during fowl hunting, occurring most normally in lake, river, wetlands or similar areas.

While preferred forms and arrangement of parts have been shown in illustrating the invention, it is to be clearly understood that various changes in details and arrangement of parts may be made without departing from the scope and spirit of this disclosure.

I claim:

1. A game call comprising a reed assembly, said reed assembly including a pair of adjacent reeds sandwiched between a reed holder and a voice channel, means for accurately locating said reeds, reed holder and voice channel in assembled relationship, means carried by said reed holder in bearing engagement with a first of said reeds inboard of a terminal end of said first reed, a barrel telescopically receiving said reed assembly, said barrel having internal abutment means in axial opposed abutting relationship to abutment means of said voice channel, said reed assembly being insertable into said barrel in a direction toward said internal abutment means, said barrel having an internal surface convergingly tapering toward said internal abutment means, and said tapered internal surface bearing against said reed holder for maintaining abutment between said barrel and voice channel abutment means and creating desired pressure at the point of bearing engagement between said reed holder bearing engagement means and said first reed whereby uniform sound characteristics are achieved after each and any assembly of said game call.

2. The game call as defined in claim 1 wherein said locating means include projecting locating pin means carried by one of said reed holder and voice channel and aperture means formed in the other of said reed holder, voice channel and reeds, and said aperture means telescopically receive said pin means.

3. The game call as defined in claim 1 wherein said locating means include projecting locating pin means carried by one of said reed holder and voice channel and aperture means formed in the other of said reed holder, voice channel and reeds, said aperture means telescopically receive said pin means, and said pin means and aperture means are arranged in pairs.

4. The game call as defined in claim 1 wherein said locating means include projecting locating pin means carried by one of said reed holder and voice channel and aperture means formed in the other of said reed holder, voice channel and reeds, said aperture means telescopically receive said pin means, and said pin means and aperture means are arranged in pairs, with one pin and aperture of each pair being longitudinally offset from the remaining pin and aperture of the same pair.

5. The game call as defined in claim 1 wherein said voice channel has a generally convex surface in opposing relationship to a second of said reeds, and second means carried by said reed holder in bearing engagement with said first reed further inboard of said first reed terminal end than said first mentioned bearing means for urging said first and second reeds into general conformity with at least a portion of said convex surface.

6. The game call as defined in claim 1 including boss means carried by said first reed adjacent its terminal end and projecting toward a terminal end of a second of said reeds to maintain said reeds at all times in minimum spaced relationship adjacent their terminal ends.

7. The game call as defined in claim 1 wherein said first and second reeds have free terminal end portions, first surfaces of said first and second reed terminal end portions being in opposed spaced relationship to each other, and the first surface of said second reed free terminal end portion having a surface finish rendering it stiffer than an opposite second surface of said second reed free terminal end portion.

8. The game call as defined in claim 1 wherein said first and second reeds have free terminal end portions, first surfaces of said first and second reed terminal end portions being in opposed spaced relationship to each other, the first surface of said second reed free terminal end portion having a surface finish rendering it stiffer than an opposite second surface of said second reed free terminal end portion, said locating means include projecting locating pin means carried by one of said reed holder and voice channel and aperture means formed in the other of said reed holder, voice channel and reeds, and said aperture means telescopically receive said pin means.

9. The game call as defined in claim 1 wherein said first and second reeds having free terminal end portions, first surface of said first and second reed terminal end portions being in opposed spaced relationship to each other, the first surface of said second reed free terminal end portion having a surface finish rendering it stiffer than an opposite second surface of said second reed free terminal end portion, said locating means include projecting locating pin means carried by one of said reed holder and voice channel and aperture means formed in the other of said reed holder, voice channel and reeds, said aperture means telescopically receive said pin means, and the second surface of said second reed free terminal end portion is unplanished.

10. The game call as defined in claim 1 including a tubular voice holder, said tubular voice holder and barrel being in telescopic relationship, means coupling said tubular voice holder and barrel in assembled relationship, and said coupling means being in the form of a coupling element received in opening means of said tubular voice holder and said barrel.

11. A game call comprising a reed assembly, said reed assembly including a pair of adjacent reeds sandwiched between a reed holder and a voice channel, means for accurately locating said reeds, reed holder and voice channel in assembled relationship, a first of said reeds being contiguous with said reed holder, a second of said reeds being contiguous with said voice channel, said first and second reeds having free terminal end portions, first surfaces of said first and second reed free terminal end portions being in opposed spaced relationship to each other, the first surface of said second reed free terminal end portion having a surface finish rendering it stiffer than an opposite second surface of said second reed free terminal end portion and a barrel housing said reed assembly.

12. The game call as defined in claim 11 wherein said second reed is formed of polymeric plastic material, and the first surface of said second reed free terminal end portion is planished.

13. The game call as defined in claim 11 wherein said locating means include projecting locating pin means carried by one of said reed holder and voice channel and aperture means formed in the other of said reed holder, voice channel and reeds, and said aperture means telescopically receive said pin means.

14. The game call as defined in claim 11 wherein said locating means include projecting locating pin means carried by one of said reed holder and voice channel and aperture means formed in the other of said reed holder, voice channel and reeds, said aperture means telescopically receive said pin means, and said pin means and aperture means are arranged in pairs.

15. The game call as defined in claim 11 wherein said locating means include projecting locating pin means carried by one of said reed holder and voice channel and aperture means formed in the other of said reed holder, voice channel and reeds, said aperture means telescopically receive said pin means, and said pin means and aperture means are arranged in pairs with one pin and aperture of each pair being longitudinally offset from the remaining pin and aperture of the same pair.

16. The game call as defined in claim 11 including means carried by said reed holder in bearing engagement with said first reed inboard of a terminal end of said first reed terminal end portion, said barrel having internal abutment means in axial opposed abutting relationship to abutment means of said voice channel, said reed assembly being insertable into said barrel in a direction toward said internal abutment means, said barrel having an internal surface convergingly tapering toward said internal abutment means, and said tapered internal surface bearing against said reed holder for maintaining abutment between said barrel and voice channel abutment means and creating desired pressure at the point of bearing engagement between said reed holder bearing engagement means and said first reed whereby uniform sound characteristics are achieved after each and any assembly of said game call.

17. The game call as defined in claim 16 wherein said first and second reeds have free terminal end portions, first surfaces of said first and second reed terminal end portions being in opposed spaced relationship to each other, the first surface of said second reed free terminal end portion having a surface finish rendering it stiffer than an opposite second surface of said second reed free terminal end portion, said locating means include projecting locating pin means carried by one of said reed holder and voice channel and aperture means formed in the other of said reed holder, voice channel and reeds, and said aperture means telescopically receive said pin means.

18. The game call as defined in claim 17 wherein said locating means include projecting locating pin means carried by one of said reed holder and voice channel and aperture means formed in the other of said reed holder, voice channel and reeds, and said aperture means telescopically receive said pin means.

19. The game call as defined in claim 16 wherein said second reed is formed of polymeric plastic material, and the first surface of said second reed free terminal end portion is planished.

20. The game call as defined in claim 16 wherein said locating means include projecting locating pin means carried by one of said reed holder and voice channel and aperture means formed in the other of said reed holder, voice channel and reeds, and said aperture means telescopically receive said pin means.

21. The game call as defined in claim 11 including a tubular voice holder, said tubular voice holder and barrel being in telescopic relationship, means coupling said tubular voice holder and barrel in assembled relationship, and said coupling means being in the form of a coupling element received in opening means of said tubular voice holder and said barrel.

22. A game call comprising a reed assembly, said reed assembly including a pair of adjacent reeds sandwiched between a reed holder and a voice channel, a barrel telescopically receiving said reed assembly, said first read having a pair of transversely spaced boss means thereon projecting toward a second of said reeds and being adapted to contact the latter for imparting desired sound characteristics to said game call upon relative vibratory motion between said reeds, said first reed having a free terminal edge disposed remote from said reed holder, and said pair of boss means are disposed inboard of and spaced from said free terminal edge.

23. The game call as defined in claim 22 including aperture means in said first reed.

24. The game call as defined in claim 23 wherein said aperture means is disposed generally along a longitudinal centerline of said first reed.

25. The game call as defined in claim 24 wherein said aperture means is disposed closer to said pair of boss means than to said free terminal edge.

26. The game call as defined in claim 23 wherein said aperture means is disposed closer to said pair of boss means than to said free terminal edge.

27. A game call comprising a reed assembly, said reed assembly including reed means sandwiched between a reed holder and a voice channel, a barrel telescopically receiving said reed assembly, a tubular voice holder, said tubular voice holder and barrel being in telescopic relationship, means coupling said tubular voice holder and barrel in assembled relationship, and said coupling means being in the form of a coupling element received in opening means of said tubular voice holder and said barrel.

28. The game call as defined in claim 27 wherein said coupling element is generally a closed loop.

29. The game call as defined in claim 28 wherein said opening means is an opening formed in a projection carried by each of said barrel and tubular voice holder, and said coupling element passes through each of said openings.

30. A game call comprising a reed assembly, said reed assembly including a pair of adjacent reeds sandwiched between a reed holder and a voice channel, means for accurately locating said reeds, reed holder and voice channel in assembled relationship, means carried by said reed holder in bearing engagement with a first of said reeds inboard of a terminal end of said first reed, a barrel telescopically receiving said reed assembly, said first reed having a pair of boss means thereon projecting toward a second of said reeds and being adapted to contact the latter, aperture means in said first reed for imparting desired sound characteristics to said game call upon relative vibratory motion between said reeds, said aperture means is disposed generally along a longitudinal center line of said first reed, said first reed including a relatively thin portion as compared to a remaining portion thereof, and said boss means and aperture means being respectively carried by and formed in said thin portion.

31. A game call comprising a reed assembly, said reed assembly including a pair of adjacent reeds sandwiched between a reed holder and a voice channel, means for accurately locating said reeds, reed holder and voice channel in assembled relationship, means carried by said reed holder in bearing engagement with a first of said reeds inboard of a terminal end of said first reed, a barrel telescopically receiving said reed assembly, said first reed having a pair of boss means thereon projecting toward a second of said reeds and being adapted to contact the latter, aperture means in said first reed for imparting desired sound characteristics to said game call upon relative vibratory motion between said reeds, said aperture means is disposed generally along a longitudinal center line of said first reed, said aperture means being disposed between terminal end portions of said first reed, said boss means being more closely adjacent to one of said terminal end portions than said aperture means, said first reed including a relatively thin portion as compared to a remaining portion thereof, and said boss means and aperture means being respectively carried by and formed in said thin portion.

32. A game call comprising a reed assembly, said reed assembly including a pair of adjacent reeds sandwiched between a reed holder and a voice channel, means for accurately locating said reeds, reed holder and voice channel in assembled relationship, a first of said reeds being contiguous with said reed holder, a second of said reeds being contiguous with said voice channel, said first and second reeds having free terminal end portions, the first surfaces of said first and second reed free terminal end portions being in opposed spaced relationship to each other, the first surface of said second reed free terminal end portion having a surface finish rendering it stiffer than an opposite second surface of said second reed free terminal end portion, means carried by said reed holder in bearing engagement with said first reed inboard of said terminal end portion of said first reed, a barrel telescopically receiving said reed assembly, said barrel having internal abutment means in axially opposed abutting relationship to abutment means of said voice channel, said reed assembly being insertable into said barrel in a direction towards said internal abutment means, said barrel having an internal surface convergingly tapering towards said internal abutment means, said tapered internal surface bearing against said reed holder for maintaining abutment between said barrel and voice channel abutment means and creating desired pressure at the point of bearing engagement between said reed holder bearing engagement means and said first reed whereby uniform sound characteristics are achieved after each and any assembly of said game call, said locating means including projecting locating pin means carried by one of said reed holder and voice channel and aperture means formed in the other of said reed holder, voice channel and reeds, said aperture means telescopically receiving said pin means, said pin means and aperture means being arranged in pairs with one pin and aperture being longitudinally offset from the remaining pin and aperture of the same pair, said first reed having a pair of boss means thereon projecting towards said second reed and being adapted to contact the latter, aperture means in said first reed for imparting desired sound characteristics to said game call upon relative vibratory motion between said reeds and said aperture means being disposed generally along a longitudinal center line of said first reed.

* * * * *